US007900609B2

(12) United States Patent
Modien et al.

(10) Patent No.: US 7,900,609 B2
(45) Date of Patent: Mar. 8, 2011

(54) DUAL EXHAUST GAS RECIRCULATION VALVE

(75) Inventors: Russell M. Modien, Jiangsu (CN); Kenneth P. Nydam, Chatham (CA); David W. Balsdon, Chatham (CA)

(73) Assignee: Continental Automotive Canada, Inc., Ontario (CA)

( * ) Notice: Subject to any disclaimer, the term of this patent is extended or adjusted under 35 U.S.C. 154(b) by 288 days.

(21) Appl. No.: 12/105,346

(22) Filed: Apr. 18, 2008

(65) Prior Publication Data

US 2008/0257316 A1 Oct. 23, 2008

Related U.S. Application Data

(60) Provisional application No. 60/912,532, filed on Apr. 18, 2007.

(51) Int. Cl.
*F02M 25/07* (2006.01)
*F02B 47/08* (2006.01)

(52) U.S. Cl. ..... 123/568.12; 123/568.2; 123/568.24

(58) Field of Classification Search ..... 123/568.11, 123/568.12, 568.2, 568.21, 568.23, 568.24; 60/605.2; 701/108; 165/103
See application file for complete search history.

(56) References Cited

U.S. PATENT DOCUMENTS

| | | | | |
|---|---|---|---|---|
| 5,617,726 | A * | 4/1997 | Sheridan et al. | 60/605.2 |
| 6,014,960 | A * | 1/2000 | Oleksiewicz | 123/568.2 |
| 6,053,154 | A * | 4/2000 | Pott | 123/568.12 |
| 6,390,078 | B1 | 5/2002 | Gee et al. | |
| 6,647,971 | B2 | 11/2003 | Vaughan et al. | |
| 6,659,427 | B2 | 12/2003 | Krimmer et al. | |
| 6,681,564 | B2 * | 1/2004 | Nishiyama et al. | 60/285 |
| 6,901,746 | B2 * | 6/2005 | Nishiyama et al. | 123/568.2 |
| 7,080,635 | B2 * | 7/2006 | Sato | 123/568.2 |
| 2006/0200297 | A1 * | 9/2006 | Liu et al. | 123/568.12 |
| 2007/0028901 | A1 * | 2/2007 | Watakabe et al. | 123/568.12 |

FOREIGN PATENT DOCUMENTS

WO 2006/111280 10/2006

OTHER PUBLICATIONS

International Search Report and Written Opinion mailed on Sep. 23, 2008.

* cited by examiner

*Primary Examiner* — Willis R Wolfe, Jr.

(57) ABSTRACT

An exhaust gas recirculation (EGR) system communicates hot exhaust gases from an exhaust manifold to an intake manifold through a first passage and a second passage parallel with the first passage. A first EGR valve assembly controls exhaust gas flow through the first passage and a second EGR valve assembly controls exhaust gas flow through the second passage. Exhaust gas is selectively flowed through one or both of the first and second passages to provide the desired temperature and flow through the intake manifold to the engine.

16 Claims, 4 Drawing Sheets

DUAL EXHAUST GAS RECIRCULATION VALVE

CROSS REFERENCE TO RELATED APPLICATION

The application claims priority to U.S. Provisional Application No. 60/912,532 all filed on Apr. 18, 2007.

BACKGROUND OF THE INVENTION

This disclosure generally relates to an exhaust gas recirculation (EGR) system for controlling the flow of exhaust gases.

Current EGR systems include an EGR valve for modulating and controlling exhaust gas flow and a bypass valve for flow path control disposed in series with the EGR valve. The bypass valve can cause internal leakage problems and complicates exhaust passage configuration and packaging.

Accordingly, it is desirable to design and develop an improved EGR system to improve performance, simplify manufacture, assembly and operation.

SUMMARY OF THE INVENTION

An example exhaust gas recirculation (EGR) system communicates hot exhaust gases from an exhaust manifold to an intake manifold through a first passage and a second passage parallel with the first passage.

A first EGR valve assembly controls exhaust gas flow through the first passage and a second EGR valve assembly controls exhaust gas flow through the second passage. The second exhaust passage directs exhaust gases through a cooler. The cooler reduces the temperature of exhaust gases being communicated to the intake manifold. The first and second EGR valves are independently actuateable to provide a desired flow and temperature of exhaust gas to the intake manifold. Exhaust gas is selectively flowed through one or both of the first and second passages to provide the desired temperature and flow through the intake manifold to the engine. Accordingly, the example EGR system provides control of exhaust gas flow and temperature by selectively controlling gas flow through parallel cooled and un-cooled passages.

These and other features of the present invention can be best understood from the following specification and drawings, the following of which is a brief description.

DETAILED DESCRIPTION OF THE PREFERRED EMBODIMENT

Figure 1:
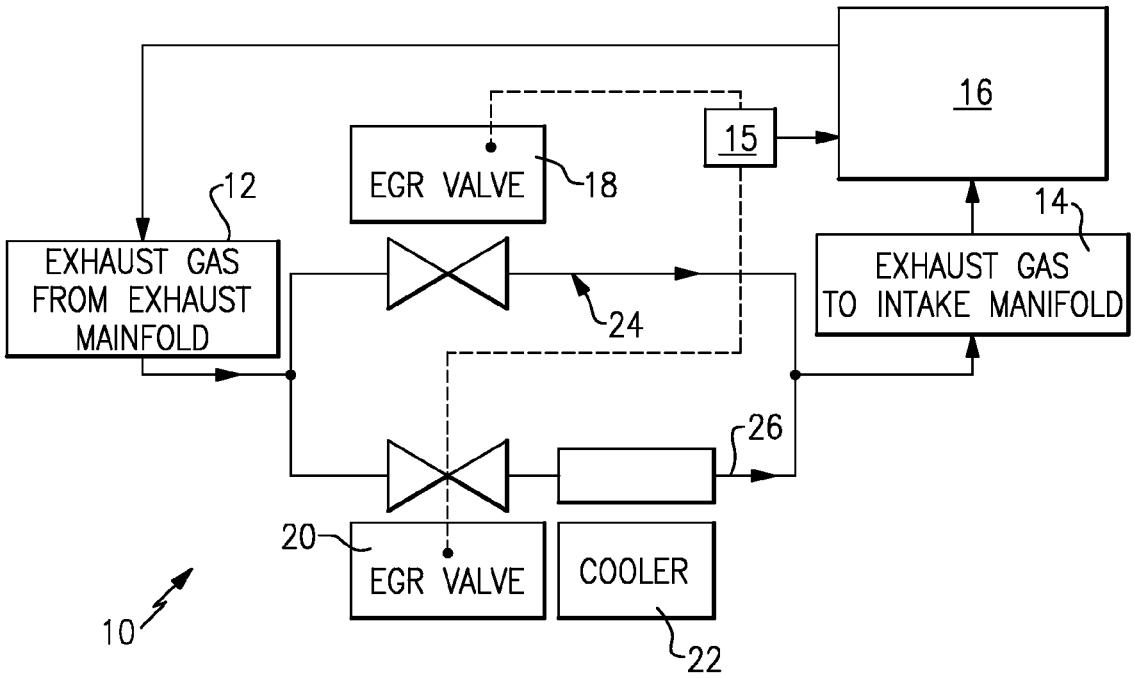
FIG. 1 is a schematic view of an example exhaust gas recirculation system.

Referring to FIG. 1, an exhaust gas recirculation (EGR) system 10 communicates hot exhaust gases produced by an engine 16 through an exhaust manifold 12 to an intake manifold 14. The flow of exhaust gas is communicated through a first passage 24 and a second passage 26 that is parallel with the first passage 24. A first EGR valve assembly 18 controls exhaust gas flow through the first passage 24 and a second EGR valve assembly 20 controls exhaust gas flow through the second passage 26. A controller 15 is utilized to control actuation of the first and second EGR valves 18,20 responsive to a desired engine operating parameter. The second exhaust passage 26 directs exhaust gases through a cooler 22. The cooler 22 reduces the temperature of exhaust gases being communicated to the intake manifold 14.

The first and second EGR valves 18, 26 are independently actuateble to provide a desired flow and temperature of exhaust gas to the intake manifold 14. The temperature of exhaust gas is controlled to provide the desired operational characteristics of the engine 16. Exhaust gas is selectively flowed through one or both of the first and second passages to provide the desired temperature and flow through the intake manifold 14 to the engine 16.

Figure 2:
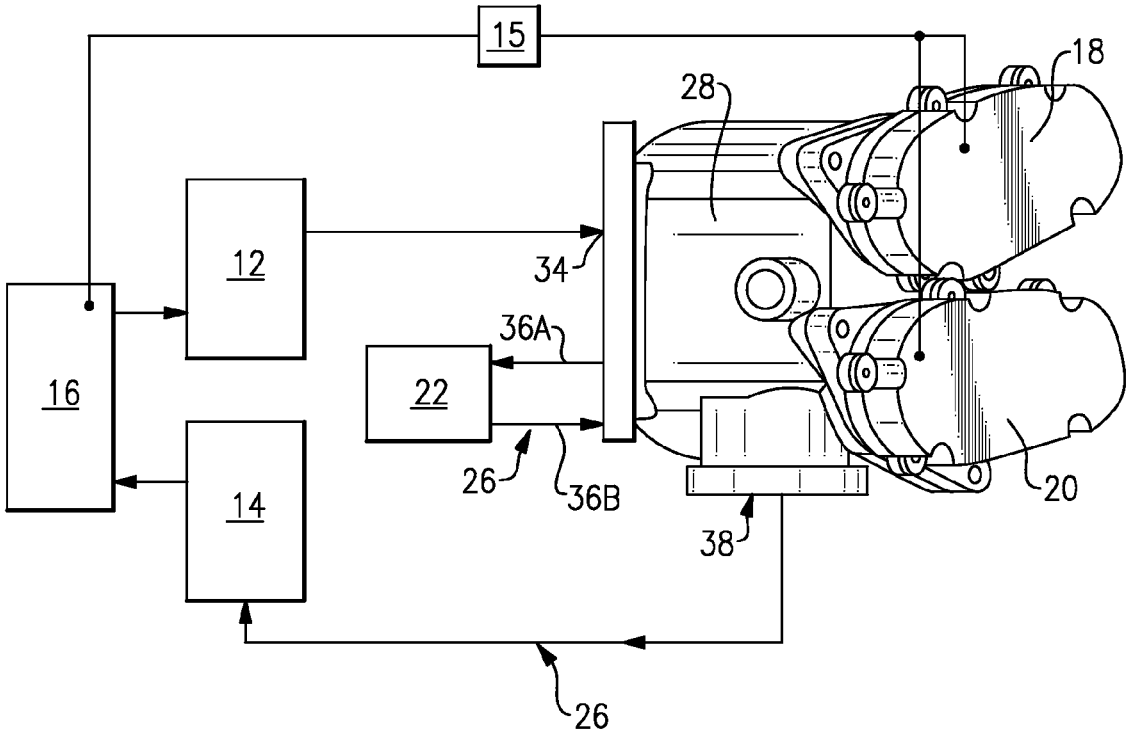
FIG. 2 is another schematic view of an example exhaust gas recirculation system.

Referring to FIG. 2, the example system 10 includes the first and second EGR valves 18, 20 mounted within a common housing 28. The housing 28 defines inlets and outlets required to route and control the flow of exhaust gases. The example first and second EGR valves 18, 20 are of a common configuration and operation to simplify assembly, manufacture and operation. Further, although the example housing 28 illustrates a common mounting location for both the first and second EGR valves 18, 20, other mounting configurations and placements are within the contemplation of this invention. For example, the first EGR valve 18 could be mounted in a location separate from the second EGR valve as is required for application specific requirements.

The example housing 28 defines only a portion of the first and second passages 24, 26. Other connections such as hoses, pipes or other cavities for directing and communicating exhaust gases between the source of the exhaust gases and the intake manifold 14 are within the contemplation of this invention.

Figure 3:
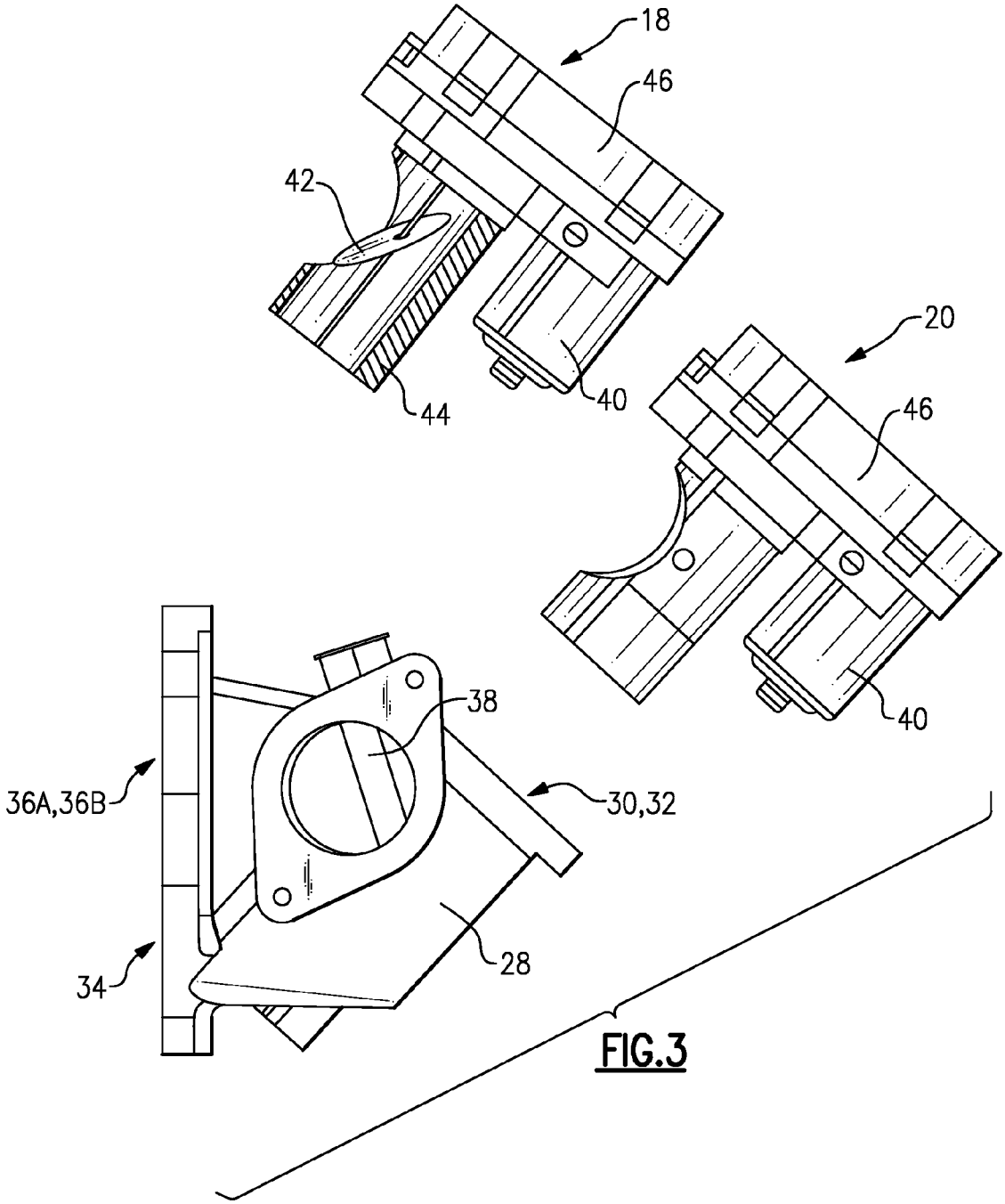
FIG. 3 is an exploded view of the example exhaust gas recirculation valve assembly.
Figure 4:
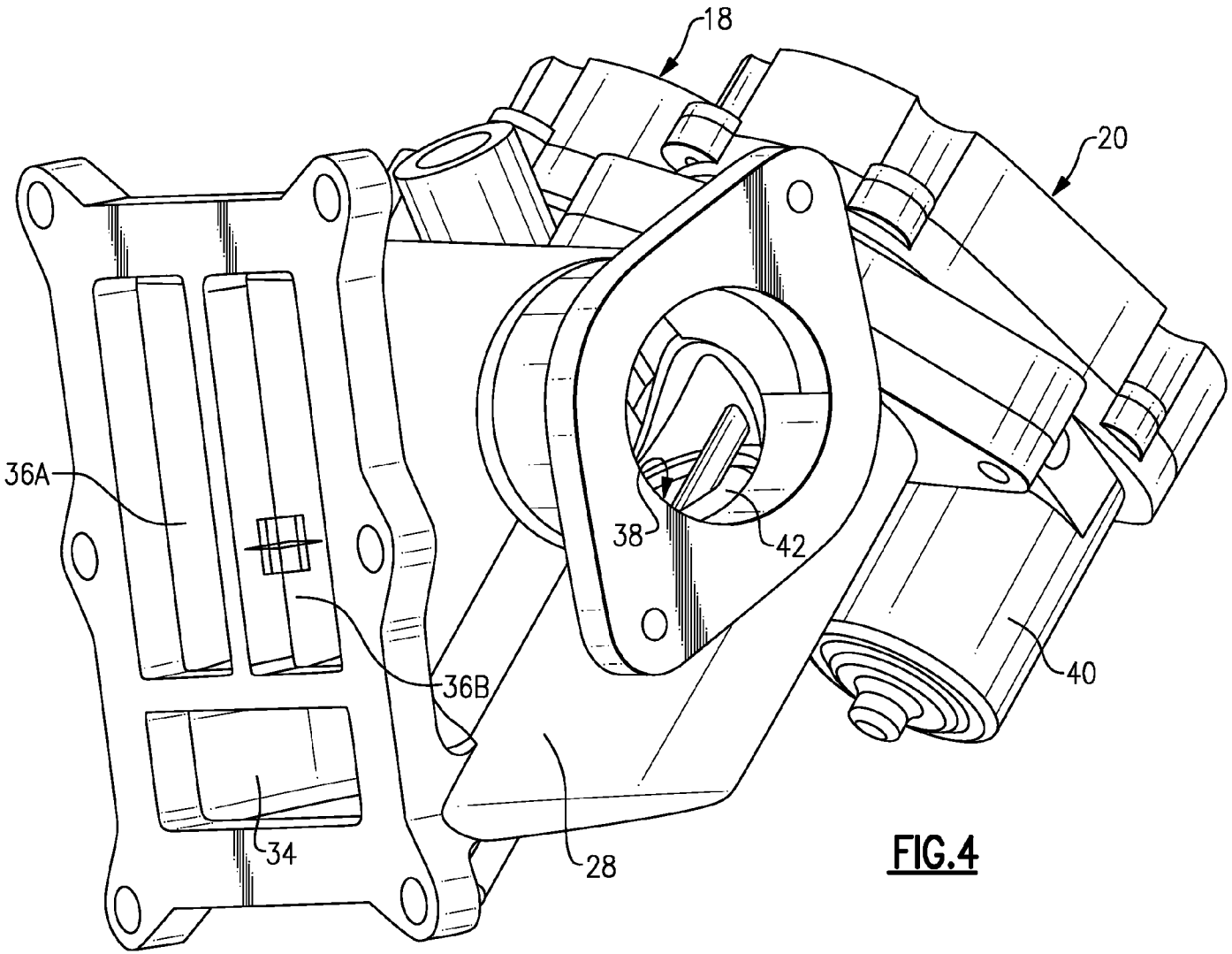
FIG. 4 is a perspective view of the example EGR valve assembly.

Referring to FIGS. 3 and 4, with continued reference to FIG. 2, the example EGR valves 18, 20 are mounted into separate bores 30, 32 of the housing 28. The bores 30, 32 are similar in that each is configured to receive one of the EGR valves 18, 20. The housing 28 includes inlet 34 for exhaust gases from the example exhaust manifold 12. A first outlet 38 communicates exhaust gases directly to the intake manifold 14 to bypass the cooler 22. A second outlet 36 A communicates exhaust gases out to a cooler 22. The cooled exhaust gases then flow back through inlet 36B into the housing and then through the outlet 38 to the intake manifold 14. The example cooler 22 provides for the control and reduction of a temperature of the exhaust gases.

The example EGR valves 18, 20 include a metering housing 44 that is received within a corresponding bore 30, 32 in the housing 28. A rotary flap valve 42 rotates within the metering housing 44 to selectively block exhaust gas flow and thereby control exhaust gas flow. The rotary flap valve 42 is driven through a drive mechanism 46 by a motor 40. The example motor 40 comprises an electric motor that is separated from the meter housing 44. The motor 40 is separate from the rotary flap valve 42 to isolate the motor 40 from temperatures encountered upon exposure to hot exhaust gases. Although a rotary flap valve is illustrated and described as a disclosed example, other EGR valve configurations such as poppet or spool type valves are also within the contemplation of this invention.

Because the example EGR system 10 includes two parallel exhaust gas paths, greater ranges of operational capabilities are possible. Exhaust gases can flow through one or some proportion of both the first passage 24 and the second passage 26. Cooled exhaust gas directed through the second passage 26 can be combined with un-cooled bypassed exhaust gas flow through the first passage 24 to obtain a desired temperature of exhaust gas at the intake manifold 12. Further, a switch between un-cooled bypassed exhaust gases is made possible by the parallel flow passages without interruption exhaust gas flow.

Operation of the system 10 includes providing the first and second 24, 26 parallel passages for exhaust gases. The example second flow passage 26 directs hot exhaust gases to a cooler 22. The example cooler 22 can be any heat exchange device as is known that provides for the reduction in temperature of exhaust gases. The controller 15 controls actuation of the EGR valves 18,20 to communicate exhaust gases from the source, in this example the exhaust manifold 12 to the intake manifold 14 and then to the engine 16. The example controller 15 is as know and can be a separate microcontroller or a part of a vehicle electronic control unit.

Each of the EGR valves 18, 20 is independently actuatable to provide a desired proportion of exhaust gas flow through each of the first and second passages 24, 26. As appreciated, any proportion from completely closed to fully open can be utilized to provide a desired mixture of cooled and un-cooled exhaust gas to obtain a desired temperature of exhaust gas to the intake manifold 14. Further, the EGR valves 18, 20 can simply be operated as on/off valves to provide cooled or un-cooled gas flow.

Accordingly, the example EGR system 10 provides control of exhaust gas flow and temperature by selectively controlling gas flow through parallel cooled and un-cooled passages.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An exhaust gas recirculation (EGR) valve assembly comprising:

a housing defining a portion of a first passage through to a main outlet, a portion of a second passage that communicates exhaust gas flow out a cooler outlet to a cooler for controlling a temperature of exhaust gases, and a third passage that receives exhaust gas flow from the cooler and communicates the exhaust gas flow from the cooler to the first passages for flow through the main outlet;

a first EGR valve mounted within the housing for controlling exhaust gas flow through the first passage;

a second EGR valve mounted within the same housing as the first EGR valve, the second EGR valve controlling exhaust gas flow through the second passage and out the cooler outlet to the cooler, wherein the second passage communicates exhaust gas received from the cooler to the first passage and the main outlet to an intake manifold.

2. The assembly as recited in claim 1, wherein the housing defines the main outlet from the first passage to an inlet manifold, a first inlet receiving exhaust gas flow, a cooler outlet in communication with the second passage for directing gas flow to the cooler and a second inlet for receiving exhaust gas flow from the cooler, the second inlet in communication with the first passage.

3. The assembly as recited in claim 1, wherein the first EGR valve and the second EGR valve comprise a rotary flap valve.

4. The assembly as recited in claim 3, wherein the first EGR valve and the second EGR valve include an actuator for driving the rotary flap valve between an open and a closed position.

5. An exhaust gas recovery (EGR) system comprising:

a first passage receiving exhaust gas and directing the exhaust gas to an intake manifold;

a second passage receiving exhaust gas and directing the exhaust gas to a cooler;

a third passage receiving exhaust gas from the cooler and directing exhaust gas to the first passage;

a common housing defining a portion of the first, second and third passages;

a first EGR valve mounted within the common housing for controlling exhaust gas flow through the first passage; and a second EGR valve mounted within the same common housing as the first EGR valve, the second EGR valve controlling exhaust gas flow through the second passage.

6. The system as recited in claim 5, wherein the first EGR valve and the second EGR valve are separately controllable for providing a desired total flow of exhaust gas to the intake manifold.

7. The system as recited in claim 5, wherein the common housing defines a main outlet from the first passage to an inlet manifold, a first inlet receiving exhaust gas flow, a cooler outlet in communication with the second passage for directing gas flow to the cooler and a second inlet for receiving exhaust gas flow from the cooler, the second inlet in communication with the first passage.

8. The system as recited in claim 5, wherein the first EGR valve is the same as the second EGR valve.

9. The system as recited in claim 8, wherein the first EGR valve and the second EGR valve comprise a flap valve movable between an open and closed position.

10. A method of controlling exhaust gas flow between a source of exhaust gas and an intake manifold comprising:

defining a portion of a first passage within a first housing between the source of exhaust gas and an intake manifold;

defining a portion of a second passage within the first housing between the source of exhaust gas to a cooler;

defining a portion of a third passage within the first housing from the cooler through to the first passage and to the intake manifold;

controlling flow of exhaust gas through the first passage with a first EGR valve mounted within the first housing by controlling flow through the portion of the first housing defined within the first housing; and controlling flow of exhaust gas through the second passage with a second EGR valve mounted within the first housing by controlling flow through the portion of the second passage defined within the first housing independent of the first EGR valve.

11. The method as recited in claim 10, including pre-cooling exhaust gas before flowing through the first EGR valve and the second EGR valve.

12. The method as recited in claim 10, wherein each of the first EGR valve and the second EGR valve comprise a rotary flap valve for selectively blocking the flow of exhaust gas through a corresponding one of the first and second passages.

13. The method as recited in claim 10, including controlling the flow of exhaust gas through the first passage and the second passage to communicate a desired total exhaust gas flow to the intake manifold.

14. The method as recited in claim 13, including the step of controlling a temperature of exhaust gas communicated to the intake manifold by selectively proportioning exhaust gas flow through the first passage and the second passage.

15. The method as recited in claim 10, including controlling the flow of exhaust gas out through the second passage to a cooler and communicating exhaust gases received back from the cooler through the third passage into the first passage.

16. The method as recited in claim 15, including the step of controlling an exhaust gas temperature communicated to the intake manifold by mixing exhaust gases received from the cooler through the third passage in the first passage.

* * * * *